US005712045A

United States Patent [19]

Miyai

[11] Patent Number: 5,712,045

[45] Date of Patent: Jan. 27, 1998

[54] PRESSURE-SENSITIVE MAGNETIC TRANSFER RECORDING MEDIUM

[75] Inventor: Kazuo Miyai, Osaka, Japan

[73] Assignee: Fujicopian Co., Ltd., Japan

[21] Appl. No.: 700,673

[22] Filed: Aug. 9, 1996

[30] Foreign Application Priority Data

Aug. 11, 1995 [JP] Japan ..... 7-206212

[51] Int. Cl.[6] ..... B41M 5/26

[52] U.S. Cl. ..... 428/522; 428/195; 428/206; 428/329; 428/532; 428/694 B

[58] Field of Search ..... 428/206, 195, 428/694 B, 522, 532, 323, 329

[56] References Cited

U.S. PATENT DOCUMENTS 5,523,167 6/1996 Hunt et al. ..... 428/206

*Primary Examiner*—Pamela R. Schwartz
*Attorney, Agent, or Firm*—Fish & Neave

[57] ABSTRACT

A pressure-sensitive magnetic transfer recording medium comprising a support and a pressure-sensitive transferable magnetic ink layer provided directly or indirectly on the support, the pressure-sensitive transferable magnetic ink layer comprising a particulate magnetic substance, a titanate type coupling agent having a solubility parameter of 8.8 to 10.6 $(cal/cm^3)^{0.5}$ and a cellulose acetate butyrate resin. The magnetic transfer recording medium produces printed magnetic images which can be read with high reliability by means of MICR.

4 Claims, No Drawings

PRESSURE-SENSITIVE MAGNETIC TRANSFER RECORDING MEDIUM

BACKGROUND OF THE INVENTION

The present invention relates to a pressure-sensitive magnetic transfer recording medium. More particularly, it relates to a pressure-sensitive magnetic transfer recording medium which allows an impact printer to easily produce printed images having high magnetic characteristics capable of being read by means of a magnetic ink character reader (hereinafter referred to as "MICR").

MICR is designed to read printed images, such as characters or marks, printed with an ink containing a magnetic substance powder on a bill, check, credit card, pass, traffic census card or the like, by means of a magnetic head. The magnetic head in the MICR converts variations of magnetic portions corresponding to various characters or marks into predetermined signals, the voltages of which are detected to recognize the characters or marks.

Characters or marks to be read by means of the magnetic head are required to have predetermined shape, dimensions and allowable ranges of dimensions as well as a predetermined magnetic signal level. In Japan, the allowable ranges with respect to E13B type face adopted in American Bank Association are prescribed in JIS×9002.

E13B type face prescribed in JIS×9002 consists of 14 characters in all, including 10 numerals (0 to 9) and 4 special marks. With respect to each character for E13B type face, JIS×9002 prescribes nominal height, width and corner radius, and allowable ranges of these nominal dimensions as well as the allowable range of void.

In addition to E13B type face, there is CMC-7 type face as type face for MICR. CMC-7 type face is designed to form a character by arranging 7 longitudinal bars with 2 kinds of intervals and any character of CMC-7 type face can be magnetically recognized by combinations of 2 kinds of intervals. CMC-7 type face consists of 41 characters in all, including 10 numerals, 26 large alphabets and 5 special marks. A standard with respect to dimensions and magnetic characteristics of CMC-7 type face characters is prescribed by ECMA (European Computer Manufactures Association).

Printed images of the above-mentioned type faces for MICR are formed by using a magnetic recording medium which is produced by applying a magnetic ink composition usually composed of a magnetic substance powder and a binder on a foundation such as plastic film and drying the resultant coating to form a pressure-sensitive transferable magnetic ink layer. With use of an impact printer such as typewriter, the pressure-sensitive transferable magnetic ink layer of the recording medium is selectively transferred onto a receiving paper by action of pressure to form a magnetic image.

Problems involved in manufacturing such a magnetic recording medium exist in dispersibility of a particulate magnetic substance into a binder and bonding property of the particulate magnetic substance to the binder. The particulate magnetic substance is used in the form of a fine powder. It is uniformly mixed with the binder and other additives in an organic solvent and the resulting dispersion is applied onto a foundation, followed by drying. However, the particulate magnetic substance is liable to be readily sedimented in the dispersion due to its extremely high specific gravity and, hence, it is very difficult to always form, on a foundation, a pressure-sensitive magnetic transfer layer wherein the particulate magnetic substance is uniformly dispersed. Mother problem is that the particulate magnetic substance is not sufficiently bonded to the binder, resulting in degraded magnetic characteristics.

A typical magnetic ink is disclosed in Japanese Examined Patent Publication No. 25485/1972, wherein a magnetic ink is incorporated with a non-drying oil, a metal soap and a non-drying oil-modified alkyl resin, thereby improving the clarity of printed images. With the magnetic ink, however, the particulate magnetic substance is liable to agglomerate due to strong mutual interaction between the particles of the magnetic substance and great saturation magnetization, resulting in degraded clearness and magnetic characteristics of printed images.

On the other hand, in a technical field of magnetic type and the like, it is proposed to use a surface-modified particulate magnetic substance. However, the technique relating to the magnetic tape and the like does not involve transfer of a magnetic layer and only fine dispersion of the particulate magnetic substance is at stake.

In view of the foregoing, it is an object of the present invention to provide a magnetic recording medium having a pressure-sensitive transferable magnetic ink layer which is capable of stably giving clear printed images having good magnetic characteristics.

This and other objects of the present invention will become apparent from the description hereinafter.

SUMMARY OF THE INVENTION

According to the present invention, there is provided to a pressure-sensitive magnetic transfer recording medium comprising a support and a pressure-sensitive transferable magnetic ink layer provided directly or indirectly on the support, the pressure-sensitive transferable magnetic ink layer comprising a particulate magnetic substance, a titanate type coupling agent having a solubility parameter of 8.8 to 10.6 $(cal/cm^3)^{0.5}$ and a cellulose acetate butyrate resin.

In an embodiment of the present invention, the titanate type coupling agent is at least one of bis(dioctyl pyrophosphate) oxyacetate titanate and isopropyl tricumylphenyl titanate.

In another embodiment of the present invention, the cellulose acetate butyrate resin has a number average molecular weight of 10,000 to 20,000.

In still another embodiment of the present invention, the pressure-sensitive transferable magnetic ink layer comprises 30 to 97% by weight of the particulate magnetic substance, 20 to 70% by weight of the cellulose acetate butyrate resin, on the basis of the total amount of the ink layer, and the titanate type coupling agent in an amount of 0.1 to 20% by weight of the amount of the particulate magnetic substance.

Herein, the term "solubility parameter" (hereinafter referred to as "SP") is a value defined by the following formulas:

$\delta^2=E/V$ $\delta=SP\ [(cal/cm^3)^{0.5}]$

E=Cohesive energy (cal/mol)

V=Molecular volume ($cm^3$/mol)

DETAILED DESCRIPTION

The pressure-sensitive transferable magnetic ink layer in accordance with the present invention is a selectively transferable pressure-sensitive ink layer in a solid or semisolid state which means that, when pressure is applied to the recording medium from the rear side of the support by means of an impact member such as wire dot pin or type face, only a portion of the ink layer onto which pressure is applied is separated from those onto which pressure is not applied and transferred to a receptor to give a printed image.

The pressure-sensitive transferable magnetic ink layer is formed by applying a magnetic ink composition onto a support, followed by drying. The magnetic ink composition is prepared by adding into an organic solvent a ferromagnetic substance powder and a binder composed of a cellulose acetate butyrate resin (hereinafter referred to as "CAB resin") as a main component and optionally an oily substance, and optionally an appropriate coloring agent, followed by uniform mixing.

The present invention is characterized in that the pressure-sensitive transferable magnetic ink layer contains a titanate type coupling agent having an SP of 8.8 to 10.6 $(cal/cm^3)^{0.5}$ (hereinafter the unit of SP value is omitted) and a CAB resin as the binder resin for the magnetic substance powder.

The titanate type coupling agent used in the present invention is that having an SP of 8.8 to 10.6. Any conventional titanate type coupling agents can be used so long as they meet this requirement. These titanate type coupling agents can be used singly or in combination of two or more species thereof. A titanate type coupling agent having an SP of 8.8 to 10.6 is excellent in bonding with a CAB resin, resulting in magnetic images having excellent abrasion resistance and durability.

Examples of the titanate type coupling agent include isopropyl tricumylphenyl titanate=Titanium, tris[(1-methyl-1-phenylethyl)phenolato](2-propanolato)-(SF=10.1), tetraisopropyl bis(dioctyl phosphite) titanate=Titanate(2-), bis[bis(2-ethylhexyl)phosphito-0"]tetrakis(2-propanolato)-, dihydrogen (SP=10.1), isopropyl tris(dioctyl pyrophosphate) titanate=Titanate(3-), [P,P-bis(2-ethylhexyl) diphosphato(2-)-0"]-bis [P,P-bis(2-ethylhexyl)diphosphato (2-)-0",0""](2-propanolato)-, trihydrogen (SP=9.2), bis (dioctyl pyrophosphate) oxyacetate titanate=Titanate(2-), bis[P,P-bis(2-ethylhexyl)diphosphato(2-)-0",0""]-[hydroxyacetate (2-)-01,02]-, dihydrogen (SP=9.2), bis (dioctyl pyrophosphate) ethylene titanate=Titanate (2-), bis [P,P-bis(2-ethylhexyl)diphosphato(2-)-0",0""][1,2-ethanediolato(2-)-0,0']-, dihydrogen (SP=9.1) and diisopropyl bis(dioctyl pyrophosphate) titanate (SP=9.0).

The CAB resin used in the present invention preferably has a butyryl group content of 10 to 70% by weight, preferably 10 to 55% by weight, an acetyl group content of 2 to 30% by weight, and 0 to 4 hydroxyl groups per 4 glucose units. Further, the CAB resin used in the present invention preferably has a number average molecular weight of 10,000 to 20,000, thereby offering excellent transfer performance. The use of a CAB resin having a number average molecular weight of less than 10,000 provides an ink layer having an excessively small cohesive force, resulting in printed images involving void and having a poor abrasion resistance due to its softness. The use of a CAB resin having a number average molecular weight of more than 20,000 provides an ink layer having an excessively large cohesive force, resulting in unclear printed images due to large force required to separate the portion of the ink layer to be transferred from the remaining portion.

Any conventional CAB resins can be used so long as they meet the above-mentioned requirements. These CAB resins can be used singly or in combination of two or more species thereof.

A preferred combination of the titanate type coupling agent and the CAB resin is that of at least one of bis(dioctyl pyrophosphate) oxyacetate titanate and isopropyl tricumylphenyl titanate, and a CAB resin having a number average molecular weight of 10,000 to 20,000. The desired transfer performance of the present invention can be more effectively exhibited by such a combination.

The pressure-sensitive transferable magnetic ink layer in accordance with the present invention preferably comprises 30 to 97% (% by weight, hereinafter the same) of a particulate magnetic substance, 20 to 70% of a CAB resin, 0 to 30%, more preferably 20 to 30% of an oily substance, 0 to 20% of a wax and 0 to 30% of a coloring agent, on the basis of the total amount of the magnetic ink layer. The titanate type coupling agent is preferably contained in an amount of 0.1 to 20%, more preferably 0.1 to 5%, of the amount of the particulate magnetic substance. The magnetic ink layer may be further incorporated with a wetting agent such as lecithin.

The magnetic ink layer can be formed by applying a coating liquid for the magnetic ink layer onto a support, followed by drying. The coating liquid is prepared by dissolving or dispersing the above-mentioned components into an organic solvent. Examples of the solvent are toluene, methyl ethyl ketone, methyl isobutyl ketone, cyclohexane, ethyl acetate, dioxane and ethylbenzene.

Usually, the particulate magnetic substance is pretreated with the specific coupling agent before mixing with other materials.

As described above, the content of the particulate magnetic substance is preferably from 30 to 97%, more preferably from 40 to 60%, on the basis of the total amount of the magnetic ink layer. When the content of the magnetic substance is lower than the above range, the resulting printed image has poor magnetic characteristics, causing a hindrance in reading the image by means of MICR. When the content of the magnetic substance is higher than the above range, the amount of the binder is decreased, resulting in poor pressure-sensitive transferability and decreased bonding strength of the printed image to a receiving paper.

Usable as the particulate magnetic substance in the present invention are magnetic iron oxides used in various types of conventional magnetic recording media. A preferred magnetic iron oxide is needle-like γ-type iron oxide ($\gamma Fe_2O_3$) prepared by using α $Fe_2O_3 \cdot H_2O$ as a starting material. The iron oxide is used in the form of a fine powder (about 1 to 0.7 μm ) to obtain a magnetic recording medium having stable coercive force, magnetic orientation, magnetic erasing effect and thermal stability.

In the present invention, examples of other magnetic substances which are favorably used in combination with the above-specified coupling agent are magnetic iron oxides containing no bond water or combined water and no physically absorbed water, such as γ-type, spinel-type, magnetoplumbite-type, garnet-type and orthoferrite-type iron oxides, oxides of metals other than iron, and eutectic mixtures of both metal oxides. Examples of the oxides of metals other than iron are chromium oxide $Cr_2O_3$, and the like. Examples of the eutectic mixtures are $CoO \cdot Fe_2O_3$, $MnO \cdot Fe_2O_3$, $NiO \cdot Fe_2O_3$, $CuO \cdot Fe_2O_3$, $MgO \cdot Fe_2O_3$, $ZnO \cdot Fe_2O_3$, and the like.

These particulate magnetic substances are preferably in a needle-like form and preferably have an aspect ratio (L/D) of 5:1 to 20:1, more preferably 5:1 to 10:1, a diameter of 0.01 to 1 μm, more preferably 0.02 to 0.5 μm, and a length of 0.05 to 20 μm, more preferably 0.1 to 5 μm.

Examples of the waxes are haze wax, ceresine wax, whale wax, carnauba wax, microcrystalline wax, and the like.

Examples of the oily substances are animal oils, vegetable oils, mineral oils, lanolin, vaseline, dioctyl phthalate, tricresyl phosphate, and the like.

Usual dyes and pigments can be used as the coloring agent without any particular limitation.

The thickness of the pressure-sensitive transferable magnetic ink layer is preferably from 2 to 25 μm.

Various conventional materials can be used as the support in the present invention. Examples of the support include plastic films such as polyolefin films, polyethylene terephthalate film, polycarbonate film, polyimide film and cellulose resin film; paper sheets such as condenser paper, laminate paper and glassine paper; laminate films such as laminate of paper sheet/plastic film; and metal foils such as aluminum foil. The thickness of the support is usually from 2 to 100 μm, and preferably from 10 to 20 μm for application of a suitable pressure to the magnetic ink layer of the recording medium.

In the present invention, various laminate structures can be employed for the recording medium of the present invention so long as the above-mentioned specific pressure-sensitive transferable magnetic ink layer is contained. For example, a release layer may be provided between the support and the magnetic ink layer, or an adhesive layer may be provided on the magnetic ink layer. Both the release layer and the adhesive layer may be provided.

When being used, the pressure-sensitive magnetic transfer recording medium of the present invention is superimposed onto a given receptor paper such as a check paper sheet in an impact printer such as typewriter and the magnetic ink layer of the recording medium is selectively transferred onto the receptor paper by application of pressure to form a magnetic image.

Since the magnetic ink layer offers excellent pressure-sensitive transferability and adhesion to a receptor paper due to the presence of CAB resin, the resulting magnetic image has a very sharp profile without void and bridging portions. Further, the magnetic image has a high accuracy in dimension so that the image can be read accurately by means of MICR, offering a high reliability.

Moreover, since the particulate magnetic substance can be uniformly dispersed at a high concentration in the pressure-sensitive transferable layer due to its surface-modification with the specific coupling agent, the resulting magnetic image offers extremely high magnetic characteristics.

Since the SP value of the coupling agent is near to that of the CAB resin as a vehicle component and, hence, the particulate magnetic substance is favorably bonded to the vehicle, the resulting magnetic image is substantially improved in abrasion resistance and durability.

The pressure-sensitive magnetic transfer recording medium of the present invention is used not only for forming magnetic character images for the above-mentioned E13B and CMC-7 type faces but also for forming other magnetic character images by means of an impact printer.

PREFERRED EMBODIMENTS

The present invention will be more fully described by way of Examples and Comparative Examples. It is to be understood that the present invention is not limited to these Examples, and various changes and modifications may be made in the invention without departing from the spirit and scope thereof.

Each coating liquid of the below-mentioned formula for the pressure-sensitive transferable magnetic ink layer was uniformly applied onto a 16 μm-thick polyethylene film and dried to form a pressure-sensitive transferable magnetic ink layer having a thickness of 6 μm, yielding a pressure-sensitive magnetic transfer recording medium. In the following, "part" means part by weight.

EXAMPLE 1

| | |
|---|---|
| Coupling agent<br>[bis(dioctyl pypophosphate) oxyacetate titanate, SP:9.2, available under commercial name "Plenact KR 138S" from AJINOMOTO CO., INC.] | 0.24 part |
| CAB resin<br>(number average molecular weight: 16,000, available under commercial name "CAB-551-0.01" from EASTMAN CHEMICAL PRODUCTS, INC.) | 4.50 parts |
| Magnetic substance powder<br>($\gamma$ $Fe_2O_3$, diameter: 0.03 μm, length: 0.2 μm) | 8.00 parts |
| Oily substance<br>(lard oil) | 4.00 parts |
| Wetting agent<br>(lecithin) | 0.35 part |
| Ink solvent<br>(ethyl acetate) | 40 parts |
| Solvent used for surface-modifying magnetic substance powder<br>(toluene) | 32 parts |

EXAMPLE 2

The same formula as in Example 1 was used except that the coupling agent was changed to the following:

Coupling agent 0.24 part (isopropyl tricumylphenyl titanate, SP:10.1, available under commercial name "Plenact KR 34S" from AJINOMOTO CO., INC.)

EXAMPLE 3

The same formula as in Example 1 was used except that the CAB resin was changed to the following:

CAB resin 1 2.50 parts (number average molecular weight: 16,000, available under commercial name "CAB-551-0.01" from EASTMAN CHEMICAL PRODUCTS, INC.)

CAB resin 2 2.00 parts (number average molecular weight: 12,000, available under commercial name "CAB-321-0.1" from EASTMAN CHEMICAL PRODUCT, INC.)

EXAMPLE 4

The same formula as in Example 1 was used except that the coupling agent was changed to the following:

Coupling agent 0.24 part [bis(dioctyl pyrophosphate) ethylene titanate, SP:9.1, available under commercial name "Plenact KR 238S" from AJINOMOTO CO., INC.]

COMPARATIVE EXAMPLE 1

The same formula as in Example 1 was used except that no coupling agent was used.

COMPARATIVE EXAMPLE 2

The same formula as in Example 1 was used except that the coupling agent was changed to the following:

Coupling agent 0.24 part (isopropyl triisostearoyl titanate, SP:8.1, available under commercial name "Plenact KR TTS" from AJINOMOTO CO., INC.)

COMPARATIVE EXAMPLE 3

The same formula as in Example 1 was used except that the CAB resin was changed to the following:

CAB resin 2.50 parts (number average molecular weight: 30,000, available under commercial name "CAB-551-0.2" from EASTMAN CHEMICAL PRODUCTS, INC.)

COMPARATIVE EXAMPLE 4

The same formula as in Example 1 was used except that the coupling agent was changed to the following:

Coupling agent 0.24 part [isopropyl tri(N-aminoethylaminoethyl) titanate, SP:12.0, available under commercial name "Plenact KR TTS" from AJINOMOTO CO., INC.]

Each of the above-mentioned ink coating liquids was prepared by the following three steps:

1. Into a desper tank were added 8.00 parts of a magnetic substance powder, 32 parts of toluene and 0. 24 part of a coupling agent, and the mixture was agitated for 10 minutes. The resulting mixture was dried under reduced pressure to give a surface—modified magnetic substance powder.
2. 4.50 parts of a CAB resin was dissolved into 40 parts of ethyl acetate by means of a homogenizer.
3. The surface-modified magnetic substance powder obtained in step 1 and the resin solution obtained in step 2 were mixed with an oily substance and a wetting agent and the resulting mixture was milled in a ball mill for 90 minutes.

Each of the thus-obtained pressure-sensitive magnetic transfer recording media was evaluated for the following properties. The results thereof are shown in Table 1.

MAGNETIC CHARACTERISTICS

Each of the pressure-sensitive magnetic transfer recording media obtained in Examples 1 to 4 and Comparative Examples 1 to 4 was slit into ribbons each having a width of 8 mm. The ribbon was loaded in a cassette for a MICR encoder (FZ-1144 made by Fuji System Kabushiki Kaisha). Printing was performed by means of the MICR encoder to print on a specified paper sheet magnetic images of E13B type face prescribed in JIS×9002 using the self printing pattern of the encoder.

For evaluation of the magnetic characteristics of the thus obtained magnetic images, the average value of signal strengths and the range of signal strengths were measured by means of MICR MATE PLUS made by CHECKMATE ELECTRONICS, INC.

TRANSFERABILITY

For the purpose of evaluating the transferability of each of the pressure-sensitive magnetic transfer recording media obtained in Examples 1 to 4 and Comparative Examples 1 to 4, printing was performed by means of the MICR encoder, FZ-1144 to print a character "▟" among E13B type faces on a specified paper sheet for the MICR encoder, FZ-1144. 64 characters of ▟ were continuously printed and characters containing void were counted.

It is judged that as the number of characters ▟ containing void is smaller, the cohesive force of the magnetic ink layer is larger and that as the number of characters ▟ containing void is larger, the cohesive force of the magnetic ink layer is smaller and the abrasion resistance of the printed image is reduced.

Further, with use of a Bond paper sheet (Strathmore Bond, cotton fiber 25% 20 lb. ) as a receptor paper, printing was performed by means of a typewritter (AP 110 made by CANON BUSINESS MACHINES, INC.) to print a character "¶" of modern font. 25 characters of ¶ were printed for every change of 0.1 within the range of the printing pressure from 2.8 to 4.0 and characters containing bridging portion were counted. The printing pressure value ranging from 2.8 to 4.0 was that prescribed in the typewriter used.

It is judged that as the number of characters ¶ containing bridging portion is smaller, the separability of the magnetic ink layer is better, resulting in a clear MICR character, and that as the number of characters ¶ containing bridging portion is larger, the separability of the magnetic ink layer is poorer, resulting an unclear MICR character.

DISPERSIBILITY OF MAGNETIC SUBSTANCE POWDER

For the purpose of evaluating dispersibility of the magnetic substance powder in the ink layer, the transmittance optical density of each of the pressure-sensitive magnetic transfer recording media obtained in Examples 1 to 4 and Comparative Examples 1 to 4 was measured by means of a densitometer, Macbeth TD-904 using black filter. It is judged that as the transmittance optical density is higher, the dispersibility of the magnetic substance powder is better.

TABLE 1

| | Example 1 | Example 2 | Example 3 | Example 4 | Comparative Example 1 | Comparative Example 2 | Comparative Example 3 | Comparative Example 4 |
|---|---|---|---|---|---|---|---|---|
| Average signal strength | 120 | 121 | 121 | 122 | 90 | 126 | 126 | 121 |
| Range of signal strength | 96–139 | 103–149 | 102–148 | 99–139 | 71–120 | 103–153 | 102–152 | 94–144 |
| Number of Character | 0 | 0 | 0 | 0 | 15 | 9 | 1 | 17 |
| ▟ containing void Number of Character | 0 | 0 | 0 | 0 | 0 | 0 | 120 | 0 |
| ¶ containing bridging portion Transmittance optical density | 2.45 | 2.47 | 2.43 | 2.44 | 2.10 | 2.50 | 2.66 | 2.50 |

The allowed values for the evaluation items shown in Table 1 are as follows:

Average signal strength: within the range of 105 to 135

Range of signal strength: minimum value: 80 maximum value: 160

Number of character

▟ containing void: zero

Number of character

¶ containing bridging portion: not more than 20

Transmittance optical density: not lower than 2.30

As is apparent from Table 1, all Examples of the present invention provided magnetic images having proper magnetic characteristics and excellent clearness.

As described above, the present invention offers the following advantages:

Since the magnetic ink layer offers excellent pressure-sensitive transferability and adhesion to a receptor paper due to the presence of CAB resin, the resulting magnetic image has a very sharp profile without void and bridging portion. Further, the magnetic image has a high accuracy in dimension so that the image can be read accurately by means of MICR, offering a high reliability.

Moreover, since the particulate magnetic substance can be uniformly dispersed at a high concentration in the pressure-sensitive transferable layer due to its surface-modification with the specific coupling agent, the resulting magnetic image offers extremely high magnetic characteristics.

Since the SP value of the coupling agent is near to that of the CAB resin as a vehicle component and, hence, the particulate magnetic substance is favorably bonded to the vehicle, the resulting magnetic image is substantially improved in abrasion resistance and durability.

In addition to the materials and ingredients used in the Examples, other materials and ingredients can be used in Examples as set forth in the specification to obtain substantially the same results.

What is claimed is:

1. A pressure-sensitive magnetic transfer recording medium comprising a support and a pressure-sensitive transferable magnetic ink layer provided directly or indirectly on the support, the pressure-sensitive transferable magnetic ink layer comprising a particulate magnetic substance, a titanate coupling agent having a solubility parameter of 8.8 to 10.6 $(cal/cm^3)^{0.5}$ and a cellulose acetate butyrate resin.

2. The pressure-sensitive magnetic transfer recording medium of claim 1, wherein the titanate coupling agent is at least one of bis(dioctyl pyrophosphate) oxyacetate titanate and isopropyl tricumylphenyl titanate.

3. The pressure-sensitive magnetic transfer recording medium of claim 1, wherein the cellulose acetate butyrate resin has a number average molecular weight of 10,000 to 20,000.

4. The pressure-sensitive magnetic transfer recording medium of claim 1, wherein the pressure-sensitive transferable magnetic ink layer comprises 30 to 97% by weight of the particulate magnetic substance, 20 to 70% by weight of the cellulose acetate butyrate resin, on the basis of the total amount of the ink layer, and the titanate coupling agent in an amount of 0.1 to 20% by weight of the amount of the particulate magnetic substance.

* * * * *

UNITED STATES PATENT AND TRADEMARK OFFICE

CERTIFICATE OF CORRECTION

PATENT NO : 5,712,045

DATED : January 27, 1998

INVENTION(S) : Miyai

It is certified that error appears in the above-identified patent and that said Letters Patent are hereby corrected as shown below:

Column 1, line 67 delete "Mother" and substitute therefor -- Another --.

Column 3, line 29 delete "(SF = 10.1)," and substitute therefor -- (SP = 10.1) --.

Column 3, line 38 delete "[hydroxyacetate" and substitute therefor -- [hydroxyacetato --.

Column 4, line 49 delete "absorbed" and substitute therefor -- adsorbed --.

Column 8, line 27 after "resulting" insert -- in --.

Signed and Sealed this

Third Day of October, 2000

*Attest:*

Q. TODD DICKINSON

*Attesting Officer*

*Director of Patents and Trademarks*